US006971488B1

(12) United States Patent
Ring et al.

(10) Patent No.: US 6,971,488 B1
(45) Date of Patent: Dec. 6, 2005

(54) SIMPLIFIED TRUCK MOUNTED BRAKE SYSTEM

(75) Inventors: Michael E. Ring, Saint John, IN (US); James M. Zemyan, Wilmerding, PA (US)

(73) Assignee: Westinghouse Air Brake Technologies Corporation, Wilmerding, PA (US)

( * ) Notice: Subject to any disclaimer, the term of this patent is extended or adjusted under 35 U.S.C. 154(b) by 0 days.

(21) Appl. No.: 10/983,908

(22) Filed: Nov. 8, 2004

(51) Int. Cl.[7] ..... B61H 13/00; B60T 11/10

(52) U.S. Cl. ..... 188/153 R; 188/219.1; 188/107; 188/33

(58) Field of Search ..... 188/49, 54, 153 R, 188/153 A, 153 D, 219.1, 207, 209, 105, 188/107, 33; 303/1, 7

(56) References Cited

U.S. PATENT DOCUMENTS 3,780,837 A * 12/1973 Haydu ..... 188/195

5,701,975 A * 12/1997 Hawryszkow ..... 188/52

* cited by examiner

*Primary Examiner*—Douglas C. Butler
(74) *Attorney, Agent, or Firm*—James Ray & Associates

(57) ABSTRACT

A brake rigging comprising first and second brake beams. A brake shoe assembly including a brake shoe adjacent each end of brake beams. A first force transfer mechanism connected intermediate first and second ends thereof to the first brake beam for moving a brake shoe into engagement with confronting wheels during braking. A second force transfer mechanism connected intermediate first and second ends thereof for moving brake shoes into engagement with confronting wheels during braking. A first force transmitting device engageable with such second brake beam for rotating such second force transfer mechanism. An adjustable length second force transmitting device having one end connected to the first force transfer mechanism and another end connected to the second force transfer mechanism and an apparatus engageable with such second force transmitting device and a portion of such brake rigging for changing a length of the second force transmitting device.

21 Claims, 3 Drawing Sheets

SIMPLIFIED TRUCK MOUNTED BRAKE SYSTEM

FIELD OF THE INVENTION

The present invention relates, in general, to railway vehicle brake systems such as are used on freight cars and, more particularly, this invention relates to a simplified truck mounted brake system for use on a railway vehicle and which can be readily adapted to retrofit onto existing railway vehicles.

BACKGROUND OF THE INVENTION

Prior to the conception and development of the present invention, numerous types of brake systems were known and used on railway cars. These prior art type brake systems include car mounted systems as well as truck mounted systems. However, each of these known brake systems have various drawbacks which are known in the railway braking art.

For example, car mounted type brake systems require several levers and linkages which are subject to frictional wear and other damage due to in track service thereby adding to costs from both an equipment investment and maintenance cost. Furthermore, these car mounted brake systems add considerable weight to the railway car. Obviously, such added weight of these car body mounted brake systems adds to the cost of operating them from a fuel consumption standpoint and can reduce the load which can be carried by the railway car.

On the other hand, although truck mounted brake systems are lighter in weight and require fewer component parts, such truck mounted brake systems are normally prone to relatively severe bending stresses. This is particularly the case, for what is commonly known in the railway industry, for brake systems using truss type brake beams.

SUMMARY OF THE INVENTION

The present invention provides an improved low cost truck mounted brake rigging for a railway vehicle. Such brake rigging includes a first brake beam disposed in a substantially horizontal plane between a first vertically disposed side of a truck bolster having each end thereof disposed intermediate each end of a respective one of a pair of side frames of a railway vehicle truck. A first wheel and axle set is disposed closely adjacent one end of such pair of side frames forming a portion of such railway vehicle truck which at least partially supports one end of such railway vehicle. There is a brake shoe assembly disposed closely adjacent each respective end of such first brake beam. A means is engageable with each brake shoe assembly and is disposed closely adjacent a respective end of such first brake beam for securing a brake shoe thereon. Such brake shoe is brought into frictional engagement with a respective confronting wheel of such first wheel and axle set during a brake application. A second brake beam is also disposed in a substantially horizontal plane between a radially opposed and vertically extending second side of such truck bolster. There is a second wheel and axle set disposed closely adjacent a radially opposed second end of such pair of side frames forming the remaining portion of such railway vehicle truck for supporting such one end of such railway vehicle. Additionally, a brake shoe assembly is disposed closely adjacent each respective end of such second brake beam. As with the first brake beam, there is a means engageable with each brake shoe assembly disposed closely adjacent the respective end of such second brake beam for securing a brake shoe thereon, which brake shoe is to be brought into frictional engagement with a respective confronting wheel of such second wheel and axle set during such brake application. A first force transfer means is pivotally connected at a predetermined point disposed intermediate a first end and a radially opposed second end of the first force transfer means to one of such first brake beam and such second brake beam for transferring a force applied thereto in order to assist in moving a brake shoe carried by a respective brake shoe assembly disposed closely adjacent such each end of such one of such first brake beam and such second brake beam into frictional engagement with such respective confronting wheel of an associated one of such first wheel and axle set and such second wheel and axle set during a brake application. A second force transfer means is pivotally connected at a predetermined point intermediate a first end and a second end of such second force transfer means to an opposite one of the first brake beam and the second brake beam for transferring a force applied thereto in order to assist in moving such brake shoes carried closely adjacent each end of such opposite one of such one of such first brake beam and such second brake beam into frictional engagement with such respective confronting wheel of an associated one of such first wheel and axle set and such second wheel and axle set during a brake application. A first force transmitting means is positioned for engagement with one of such first brake beam, such second brake beam and a vertically positioned predetermined side wall portion of such bolster member. This first force transmitting means includes a first rod like member having a first end thereof connected to one predetermined end of one of such first force transfer means and the second force transfer means. The first force transmitting means further includes a second rod like member having a first end thereof connected to one predetermined end of an opposite one of such one of such first force transfer means and such second force transfer means. At least one of the first rod like member and such second rod like member being extendable and passing through a first opening formed through such vertical predetermined side wall portion of such bolster member and a radially opposed first opening formed through a radially opposed vertical side wall of such bolster and having a second end thereof connected to a first side of a piston like member. The first force transmitting means further includes a means for exerting fluid pressure on a radially opposed second side of the piston like member thereby extending such at least one of such first rod like member and such second rod like member and thereby effecting rotation of such one of such first force transfer means and such second force transfer means. An adjustable length second force transmitting means is disposed through a second opening formed through such vertical predetermined side wall portion of such bolster member and a radially opposed second opening formed through such radially opposed vertical side wall of such bolster. One end of such adjustable length second force transmitting means is connected to a second end of such one of such first force transfer means and such second force transfer means and another end of the adjustable length second force transmitting means is connected to a second end of an opposite one of the first force transfer means and the second force transfer means. Finally, there is a means engageable with such adjustable length second force transmitting means and a predetermined portion of such brake rigging for effecting a change in a length of the adjustable length second force transmitting means as necessary due to at least one of wear of the brake shoes attached to such brake shoe assembly disposed closely adjacent each end of each of such first brake beam and the second brake beam and loss of a brake shoe from at least one brake shoe assembly.

According to a second aspect, the present invention provides a brake rigging for a railway vehicle which includes a first brake beam disposed in a substantially horizontal plane between a first vertically disposed side of a truck bolster having each end thereof disposed intermediate each end of a respective one of a pair of side frames of a railway vehicle truck and a first wheel and axle set disposed closely adjacent one end of such pair of side frames forming a portion of such railway vehicle truck at least partially supporting one end of such railway vehicle. The first brake beam being disposed adjacent an outer end of such railway vehicle truck. A brake shoe assembly is disposed closely adjacent each respective end of this first brake beam. There is a means engageable with each such brake shoe assembly disposed closely adjacent a respective end of the first brake beam for securing a brake shoe thereon to be brought into frictional engagement with a respective confronting wheel of such first wheel and axle set during a brake application. A second brake beam is disposed in a substantially horizontal plane between a radially opposed and vertically disposed second side of such truck bolster and a second wheel and axle set disposed closely adjacent a radially opposed second end of such pair of side frames forming a remaining portion of such railway vehicle truck supporting such one end of such railway vehicle. The second brake beam assembly being disposed towards an inner end of such railway vehicle truck. Another brake shoe assembly is disposed closely adjacent each respective end of such second brake beam. Further, there is a means engageable with each brake shoe assembly disposed closely adjacent such respective end of the second brake beam for securing a brake shoe thereon to be brought into frictional engagement with a respective confronting wheel of said second wheel and axle set during such brake application. A first force transfer means is pivotally connected at a predetermined point disposed intermediate a first end and a radially opposed second end of such first force transfer means to the first brake beam for transferring a force applied thereto in order to assist in moving a brake shoe carried by a respective brake shoe assembly disposed closely adjacent each end of such first brake beam into frictional engagement with such respective confronting wheel of an associated one of such first wheel and axle set during a brake application. A second force transfer means is pivotally connected at a predetermined point intermediate a first end and a second end thereof to such second brake beam for transferring a force applied thereto in order to assist in moving such brake shoes carried closely adjacent each end of the second brake beam into frictional engagement with such respective confronting wheel of an associated one of such second wheel and axle set during a brake application. There is a first force transmitting means engageable with the second brake beam. The first force transmitting means includes a first rod like member having a first end thereof connected to one predetermined end of such first force transfer means. This first force transmitting means further includes a second rod like member having a first end thereof connected to one predetermined end said second force transfer means. The second rod like member being extendable and having a second end thereof connected to a first side of a piston like member. Such first force transmitting means further having a means for exerting fluid pressure on a radially opposed second side of the piston like member thereby extending such second rod like member and effecting rotation of the second force transfer means. An adjustable length second force transmitting means has one end thereof connected to a second end of such first force transfer means and another end thereof connected to the second force transfer means. Finally, there is a means engageable with such adjustable length second force transmitting means and a predetermined portion of such brake rigging for effecting a change in a length of such adjustable length second force transmitting means as necessary due to at least one of wear of brake shoes attached to the brake shoe assembly disposed closely adjacent each end of each of such first brake beam and such second brake beam and loss of a brake shoe from at least one brake shoe assembly.

OBJECTS OF THE INVENTION

It is, therefore, one of the primary objects of the present invention to provide a simplified truck mounted brake system which can be easily retrofitted onto existing railway cars as well as being installed on newly constructed cars.

Another object of the present invention is to provide a simplified truck mounted brake system which will require less maintenance to maintain in proper working order.

Still another object of the present invention is to provide a simplified truck mounted brake system which requires a minimum of component parts.

Yet another object of the present invention is to provide a simplified truck mounted brake system which is relatively light weight.

Still yet another object of the present invention is to provide a simplified truck mounted brake system which requires less brake pipe per car.

A further object of the present invention is to provide a simplified truck mounted brake system which will reduce fuel consumption and/or enable a heavier payload to be carried by the rail car.

An additional object of the present invention is to provide a simplified truck mounted brake system which is less costly to produce than car mounted railway brake systems.

Still yet another object of the present invention is to provide a simplified truck mounted brake system in which the braking forces can be more evenly balanced.

Another object of the present invention is to provide a simplified truck mounted brake system which is relatively easy to install.

It is a further object of the present invention to provide a simplified truck mounted brake system in which the braking forces required can be achieved by a single properly sized brake cylinder.

In addition to the various objects and advantages of the present invention which have been described with some degree of specificity above, it should be understood that various additional objects and advantages of the instant invention will become more readily apparent to those persons who are skilled in the relevant art from the following more detailed description of the invention, particularly, when such description is taken in conjunction with the attached drawing figures and with the appended claims.

Figure 1:
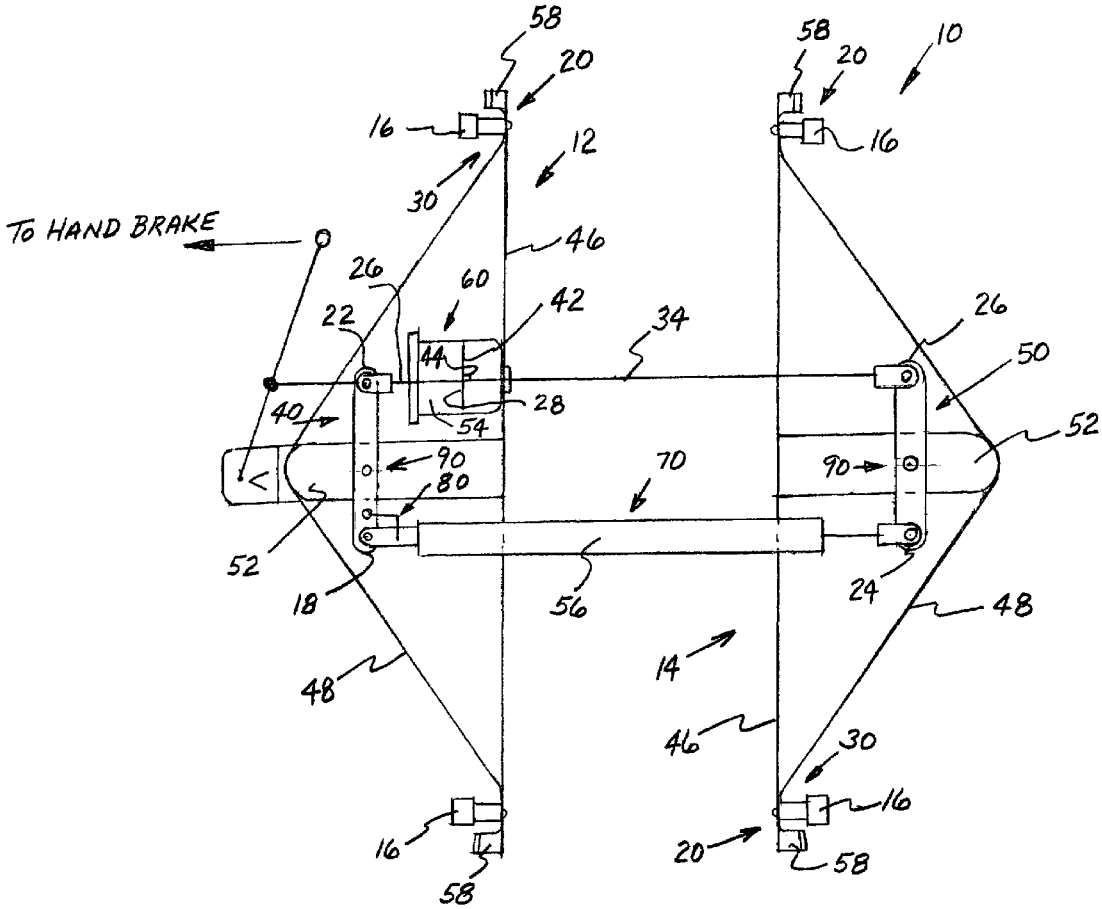
FIG. 1 is a schematic illustration of one embodiment of a truck mounted brake assembly according to the present invention.

BRIEF DESCRIPTION OF A PRESENTLY PREFERRED AND VARIOUS ALTERNATIVE EMBODIMENTS OF THE INVENTION

Prior to proceeding to the more detailed description of the instant invention it should be noted that, for the sake of clarity and understanding of the invention, identical components which have identical functions have been identified with identical reference numerals throughout the several views which have been illustrated in the attached drawing figures.

Figure 2:
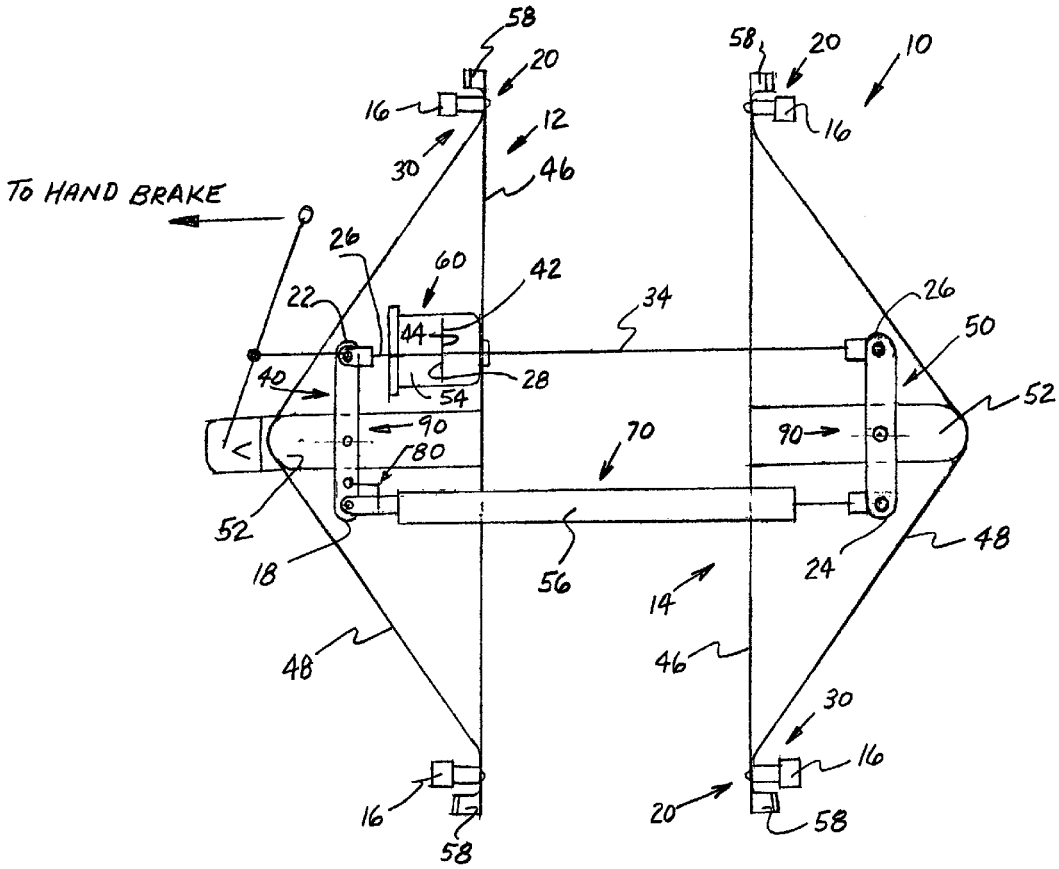
FIG. 2 is a schematic illustration of one alternative embodiment of a truck mounted brake assembly according to the present invention.
Figure 3:
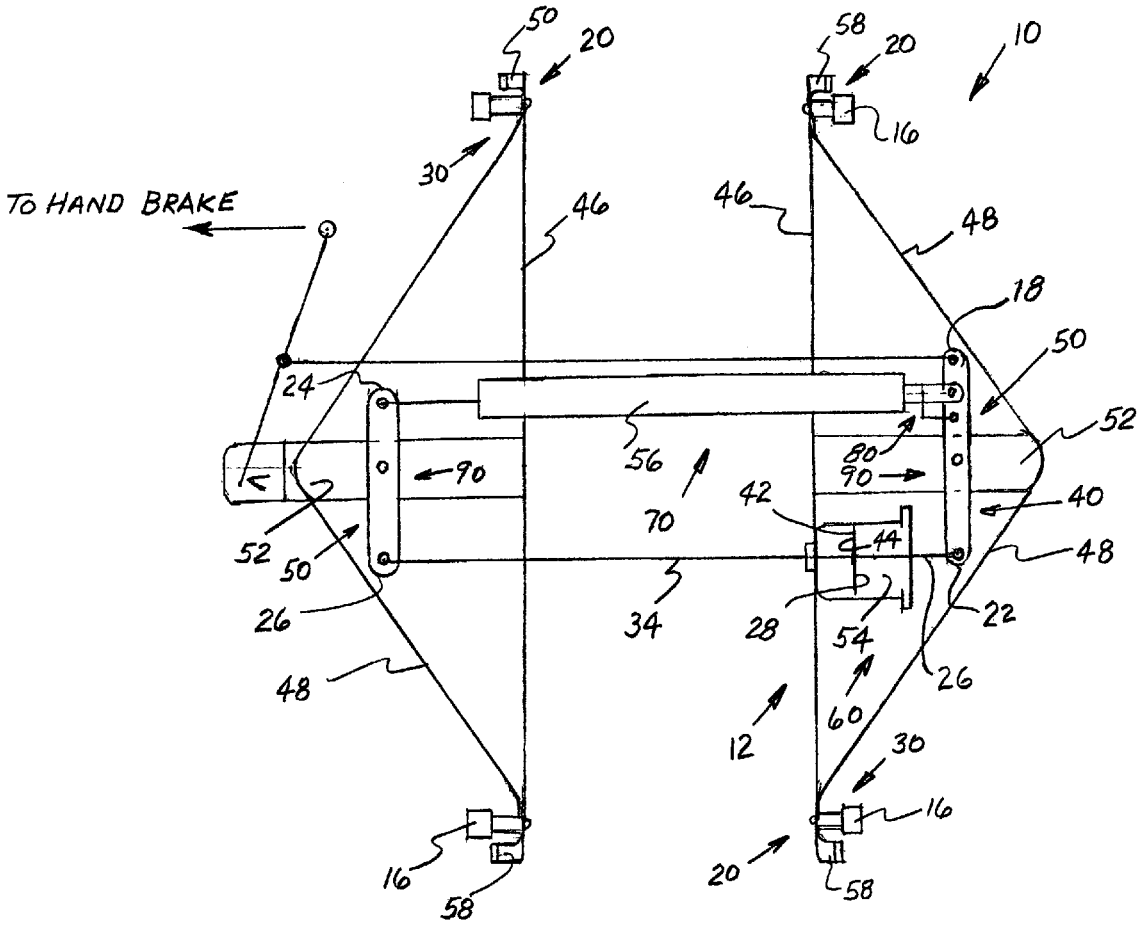
FIG. 3 is a schematic illustration of another alternative embodiment of a truck mounted brake assembly according to the present invention.

Reference is now made more particularly to the drawing FIGS. 1–3. A brake rigging, generally designated 10, for a railway vehicle (not shown). The brake rigging 10 includes a first brake beam 12 disposed in a substantially horizontal plane between a first vertically disposed side of a truck bolster (not shown) having each end (not shown) thereof disposed intermediate each end of a respective one of a pair of side frames (not shown) of a railway vehicle truck (not shown) and a first wheel and axle set (not shown) disposed closely adjacent one end (not shown) of such pair of side frames (not shown) forming a portion of such railway vehicle truck (not shown) at least partially supporting one end of such railway vehicle (not shown).

A brake shoe assembly, generally designated 20, disposed closely adjacent each respective end of the first brake beam 12. There is a means, generally designated 30, engageable with each brake shoe assembly 20 disposed closely adjacent a respective end of such first brake beam 12 for securing a brake shoe 16 thereon to be brought into frictional engagement with a respective confronting wheel (not shown) of such first wheel and axle set (not shown) during a brake application.

A second brake beam 14 disposed in a substantially horizontal plane between a radially opposed and vertically disposed second side (not shown) of such truck bolster (not shown) and a second wheel and axle set (not shown) disposed closely adjacent a radially opposed second end (not shown) of such pair of side frames (not shown) forming a remaining portion of such railway vehicle truck (not shown) supporting such one end of such railway vehicle (not shown). As with the first brake beam 12 there is a brake shoe assembly 20 disposed closely adjacent each respective end of such second brake beam 14 and a means 30 engageable with each such brake shoe assembly 20 disposed closely adjacent such respective end of the second brake beam 14 for securing a brake shoe 16 thereon to be brought into frictional engagement with a respective confronting wheel (not shown) of the second wheel and axle set (not shown) during such brake application.

A first force transfer means, generally designated 40, is pivotally connected at a predetermined point disposed intermediate a first end 18 and a radially opposed second end 22 of such first force transfer means 40 to one of such first brake beam 12 and the second brake beam 14 for transferring a force applied thereto in order to assist in moving a brake shoe 16 carried by a respective brake shoe assembly 20 disposed closely adjacent said each end of one of the first brake beam 12 and such second brake beam 14 into frictional engagement with such respective confronting wheel (not shown) of an associated one of such first wheel and axle set (not shown) and such second wheel and axle set (not shown) during a brake application.

A second force transfer means, generally designated 50, is pivotally connected at a predetermined point intermediate a first end 24 and a second end 26 of the second force transfer means 50 to an opposite one of such first brake beam 12 and the second brake beam 14 for transferring a force applied thereto in order to assist in moving such brake shoes 16 carried closely adjacent each end of such opposite one of such one of such first brake beam 12 and the second brake beam 14 into frictional engagement with such respective confronting wheel (not shown) of an associated one of such first wheel and axle set (not shown) and such second wheel and axle set (not shown) during a brake application.

A first force transmitting means, generally designated 60, is engageable with one of such first brake beam 12, such second brake beam 14 and a vertical predetermined side wall portion (not shown) of such bolster member (not shown). This first force transmitting means 60 includes a first rod like member 28 having a first end 32 thereof connected to one predetermined end of one of such first force transfer means 40 and such second force transfer means 50. The first force transmitting means 60 further includes a second rod like member 34 having a first end 36 thereof connected to one predetermined end of an opposite one of such one of such first force transfer means 40 and the second force transfer means 50. At least one of such first rod like member 28 and the second rod like member 34 being extendable and passing through a first opening (not shown) formed through such vertical predetermined side wall portion (not shown) of such bolster member (not shown) and a radially opposed first opening (not shown) formed through a radially opposed vertical side wall (not shown) of such bolster member (not shown) and having a second end thereof connected to a first side 38 of a piston like member 42. The first force transmitting means 60 further includes a means for exerting fluid pressure on a radially opposed second side 44 of the piston like member 42 thereby extending the at least one of such first rod like member 28 and the second rod like member 34 and effecting rotation of one of the first force transfer means 40 and the second force transfer means 50.

There is an adjustable length second force transmitting means, generally designated 70, disposed through a second opening (not shown) formed through such vertical predetermined side wall portion (not shown) of such bolster member (not shown) and a radially opposed second opening (not shown) formed through such radially opposed vertical side wall (not shown) of such bolster member (not shown). One end of the adjustable length second force transmitting means 70 connected to a second end of one of the first force transfer means 40 and such second force transfer means 50 and another end of the adjustable length second force transmitting means 70 connected to a second end of an opposite one of such first force transfer means 40 and such second force transfer means 50.

A trigger means, generally designated 80, is engageable with such adjustable length second force transmitting means 70 and a predetermined portion of such brake rigging 10 for effecting a change in a length of the adjustable length second force transmitting means 70 as necessary due to at least one of wear of brake shoes 16 attached to the brake shoe assembly 20 disposed closely adjacent each end of each of the first brake beam 12 and such second brake beam 14 and loss of a brake shoe 16 from at least one brake shoe assembly 20.

In one form of the presently preferred embodiment of the invention at least one of the first brake beam 12 and such second brake beam 14 include a compression member 46 and a tension member 48 and strut member 52 disposed intermediate each end of such first brake beam 12 and such second brake beam 14. Such strut member 52 having a first end thereof engageable with one of such compression member 46 and such tension member 48 and a second end thereof engageable with an opposite one of such compression member 46 and such tension member 48. A respective strut member 52 including means, generally designated 90, for providing a pivotal connection for a respective one of such first force transfer means 40 and the second force transfer means 50.

In the most presently preferred embodiment of the invention each of such first brake beam 12 and such second brake beam 14 include a compression member 46 and a tension member 48 and strut member 52 disposed intermediate each end of the first brake beam 12 and the second brake beam 14 and having a first end thereof engageable with one of such compression member 46 and the tension member 48 and a second end thereof engageable with an opposite one of such compression member 46 and such tension member 48. A respective strut member 52 including means 90 for providing a pivotal connection for a respective one of such first force transfer means 40 and such second force transfer means 50.

It is also presently preferred that the pivotal connection provided by each such respective strut member 52 for a respective one of such first force transfer means 40 and such second force transfer means 50 is disposed substantially at a midpoint of a respective one of such first brake beam 12 and such second brake beam 14.

In the presently most preferred embodiment of the invention the pivot point of at least one of such first force transfer means 40 and such second force transfer means 50 is offset by a predetermined distance from a midpoint thereof. Preferably, the pivot point of each of such first force transfer means 40 and such second force transfer means 50 is offset by a predetermined distance from a midpoint thereof.

It is also preferred that such offset by such predetermined distance from the midpoint of such pivot point be substantially identical but reversed end to end with respect to such first force transfer means 40 and such second force transfer means 50.

Preferably, the first force transmitting means 60 is a fluid pressure operated brake cylinder 54 which is mounted on one of such first brake beam 12 and such second brake beam 14.

In an alternative embodiment of the invention, the fluid pressure operated brake cylinder 54 can be mounted on such vertical predetermined side wall portion (not shown) of such bolster member (not shown).

According to the present invention, in the brake rigging 10 for a railway vehicle (not shown), such adjustable length second force transmitting means 70 acts as a solid rod like member during a brake application and becomes adjustable upon a brake release. Preferably, such adjustable length second force transmitting means 70 is a slack adjuster 56 which includes the trigger means 80. Such trigger means 80 is preferably pivotable and such means engageable a predetermined portion of such brake rigging 10 engages with such trigger means 80 for effecting a change in a length of such slack adjuster 56.

Likewise, it is presently preferred that each of such first brake beam 12 and such second brake beam 14 include guide means 58 disposed at each outer end thereof.

Preferably, the compression member 46 of each of such first brake beam 12 and the second brake beam 14 include guide means 58 disposed at each outer end thereof which are slideably engaged in channels (not shown) disposed inside each side frame (not shown) of such pair of side frames (not shown) for guiding such brake rigging 10 during such brake application.

The means 30 engageable with each such brake shoe assembly 20 disposed closely adjacent such respective end of each such first brake beam 12 and such second brake beam 14 for securing a brake shoe 16 thereon to be brought into frictional engagement with a respective confronting wheel (not shown) of such second wheel and axle set (not shown) during such brake application includes a key (not shown).

Preferably, each of such first force transfer means 40 and such second force transfer means 50 includes at least one lever.

Alternatively, at least one of such first force transfer means 40 and such second force transfer means 50 includes a pair of levers.

In one presently preferred alternative embodiment of the invention, as best seen in FIG. 3, there is provided a brake rigging 10 for a railway vehicle (not shown) which comprises a first brake beam 12 disposed in a substantially horizontal plane between a first vertically disposed side (not shown) of a truck bolster (not shown) having each end thereof disposed intermediate each end of a respective one of a pair of side frames (not shown) of a railway vehicle truck (not shown) and a first wheel and axle set (not shown) disposed closely adjacent one end of such pair of side frames (not shown) forming a portion of such railway vehicle truck (not shown) at least partially supporting one end of such railway vehicle (not shown). Such first brake beam 12 being disposed adjacent an outer end of such railway vehicle truck (not shown). A brake shoe assembly 20 is disposed closely adjacent each respective end of such first brake beam 12.

There is a means, generally designated 30, engageable with each brake shoe assembly 20 disposed closely adjacent a respective end of such first brake beam 12 for securing a brake shoe 16 thereon to be brought into frictional engagement with a respective confronting wheel (not shown) of such first wheel and axle set (not shown) during a brake application.

A second brake beam 14 is disposed in a substantially horizontal plane between a radially opposed and vertically disposed second side (not shown) of such truck bolster (not shown) and a second wheel and axle set (not shown) disposed closely adjacent a radially opposed second end (not shown) of such pair of side frames (not shown) forming a remaining portion of such railway vehicle truck (not shown) supporting such one end of such railway vehicle (not shown). The second brake beam assembly 14 being disposed towards an inner end of such railway vehicle truck (not shown). As with the first brake beam 12 there is brake shoe assembly 20 disposed closely adjacent each respective end of said second brake beam 14.

There is a means 30 engageable with each said brake shoe assembly 20 disposed closely adjacent said respective end of such second brake beam 14 for securing a brake shoe 16 thereon to be brought into frictional engagement with a respective confronting wheel (not shown) of such second wheel and axle set (not shown) during such brake application.

A first force transfer means 40 is pivotally connected at a predetermined point disposed intermediate a first end and a radially opposed second end of such first force transfer means 40 to such first brake beam 12 for transferring a force applied thereto in order to assist in moving a brake shoe 16 carried by a respective brake shoe assembly 20 disposed closely adjacent each end of such first brake beam 12 into frictional engagement with such respective confronting wheel (not shown) of an associated one of such first wheel and axle set (not shown) during a brake application.

A second force transfer means 50 ispivotally connected at a predetermined point intermediate a first end and a second end of such second force transfer means 50 to the second brake beam 14 for transferring a force applied thereto in order to assist in moving such brake shoes 16 carried closely adjacent each end of such second brake beam 14 into frictional engagement with such respective confronting wheel (not shown) of an associated one of such second wheel and axle set (not shown) during a brake application.

In this embodiment, a first force transmitting means 60 is engageable with the second brake beam 14. Such first force transmitting means 60 includes a first rod like member 28 having a first end thereof connected to one predetermined end of said first force transfer means 60. Such first force transmitting means 60 further includes a second rod like member 34 having a first end thereof connected to one predetermined end such second force transfer means 60. The second rod like member 34 being extendable and having a second end thereof connected to a first side of a piston like member 42. The first force transmitting means 60 also includes a means for exerting fluid pressure on a radially opposed second side of such piston like member 42 thereby extending the second rod like member 34 and effecting rotation of such second force transfer means 50.

An adjustable length second force transmitting means 70 having one end thereof connected to a second end of such first force transfer means 40 and another end thereof connected to such second force transfer means, 50 is provided. Finally, a trigger means 80 is engageable with such adjustable length second force transmitting means 70 and a predetermined portion of the brake rigging 10 for effecting a change in a length of such adjustable length second force transmitting means 70 as necessary due to at least one of wear of brake shoes 16 attached to the brake shoe assembly 20 disposed closely adjacent each end of each of said first brake beam 12 and said second brake beam 14 and loss of a brake shoe 16 from at least one brake shoe assembly 20.

While in accordance with the patent statutes there has been shown and described a presently preferred and a number of alternative embodiments of the present invention, it should be recognized that various other modifications and alterations can be made by those persons who are skilled in the art without departing from either the spirit of the invention or the scope of the appended claims.

We claim:

1. A brake rigging for a railway vehicle, said brake rigging comprising:

(a) a first brake beam disposed in a substantially horizontal plane between a first vertically disposed side of a truck bolster having each end thereof disposed intermediate each end of a respective one of a pair of side frames of a railway vehicle truck and a first wheel and axle set disposed closely adjacent one end of such pair of side frames forming a portion of such railway vehicle truck at least partially supporting one end of such railway vehicle;

(b) a brake shoe assembly disposed closely adjacent each respective end of said first brake beam;

(c) means engageable with each said brake shoe assembly disposed closely adjacent a respective end of said first brake beam for securing a brake shoe thereon to be brought into frictional engagement with a respective confronting wheel of such first wheel and axle set during a brake application;

(d) a second brake beam disposed in a substantially horizontal plane between a radially opposed and vertically disposed second side of such truck bolster and a second wheel and axle set disposed closely adjacent a radially opposed second end of such pair of side frames forming a remaining portion of such railway vehicle truck supporting such one end of such railway vehicle;

(e) a brake shoe assembly disposed closely adjacent each respective end of said second brake beam;

(f) means engageable with each said brake shoe assembly disposed closely adjacent said respective end of said second brake beam for securing a brake shoe thereon to be brought into frictional engagement with a respective confronting wheel of said second wheel and axle set during such brake application;

(g) a first force transfer means pivotally connected at a predetermined point disposed intermediate a first end and a radially opposed second end of said first force transfer means to one of said first brake beam and said second brake beam for transferring a force applied thereto in order to assist in moving a brake shoe carried by a respective said brake shoe assembly disposed closely adjacent said each end of said one of said first brake beam and said second brake beam into frictional engagement with such respective confronting wheel of an associated one of such first wheel and axle set and such second wheel and axle set during a brake application;

(h) a second force transfer means pivotally connected at a predetermined point intermediate a first end and a second end of said second force transfer means to an opposite one of said first brake beam and said second brake beam for transferring a force applied thereto in order to assist in moving such brake shoes carried closely adjacent each end of said opposite one of said one of said first brake beam and said second brake beam into frictional engagement with such respective confronting wheel of an associated one of such first wheel and axle set and such second wheel and axle set during a brake application;

(i) a first force transmitting means engageable with one of said first brake beam, said second brake beam and a vertical predetermined side wall portion of such bolster member, said first force transmitting means including a first rod like member having a first end thereof connected to one predetermined end of one of said first force transfer means and said second force transfer means, said first force transmitting means further including a second rod like member having a first end thereof connected to one predetermined end of an opposite one of said one of said first force transfer means and said second force transfer means, at least one of said first rod like member and said second rod like member being extendable and passing through a first opening formed through such vertical predetermined side wall portion of such bolster member and a radially opposed first opening formed through a radially opposed vertical side wall of such bolster and having a second end thereof connected to a first side of a piston like member, said first force transmitting means further including a means for exerting fluid pressure on a radially opposed second side of said piston like member thereby extending said at least one of said first rod like member and said second rod like member and effecting rotation of said one of said first force transfer means and said second force transfer means;

(j) an adjustable length second force transmitting means disposed through a second opening formed through such vertical predetermined side wall portion of such bolster member and a radially opposed second opening formed through such radially opposed vertical side wall of such bolster, one end of said adjustable length second force transmitting means connected to a second end of said one of said first force transfer means and said second force transfer means and another end of said adjustable length second force transmitting means connected to a second end of an opposite one of said first force transfer means and said second force transfer means; and (k) a means engageable with said adjustable length second force transmitting means and a predetermined portion of said brake rigging for effecting a change in a length of said adjustable length second force transmitting means as necessary due to at least one of wear of brake shoes attached to said brake shoe assembly disposed closely adjacent each end of each of said first brake beam and said second brake beam and loss of a brake shoe from at least one brake shoe assembly.

2. A brake rigging for a railway vehicle, according to claim 1, wherein at least one of said first brake beam and said second brake beam include a compression member and a tension member and strut member disposed intermediate each end of said first brake beam and said second brake beam and having a first end thereof engageable with one of said compression member and said tension member and a second end thereof engageable with an opposite one of said compression member and said tension member, a respective strut member including means for providing a pivotal connection for a respective one of said first force transfer means and said second force transfer means.

3. A brake rigging for a railway vehicle, according to claim 2, wherein each of said first brake beam and said second brake beam include a compression member and a tension member and strut member disposed intermediate each end of said first brake beam and said second brake beam and having a first end thereof engageable with one of said compression member and said tension member and a second end thereof engageable with an opposite one of said compression member and said tension member, a respective strut member including means for providing a pivotal connection for a respective one of said first force transfer means and said second force transfer means.

4. A brake rigging for a railway vehicle, according to claim 3, wherein said pivotal connection provided by each said respective strut member for a respective one of said first force transfer means and said second force transfer means is disposed substantially at a midpoint of a respective one of said first brake beam and said second brake beam.

5. A brake rigging for a railway vehicle, according to claim 4, wherein a pivot point of at least one of said first force transfer means and said second force transfer means is offset by a predetermined distance from a midpoint thereof.

6. A brake rigging for a railway vehicle, according to claim 5, wherein a pivot point of each of said first force transfer means and said second force transfer means is offset by a predetermined distance from a midpoint thereof.

7. A brake rigging for a railway vehicle, according to claim 6, wherein said offset by said predetermined distance from said midpoint of said pivot point is substantially identical but reversed end to end with respect to said first force transfer means and said second force transfer means.

8. A brake rigging for a railway vehicle, according to claim 1, wherein said first force transmitting means is a fluid pressure operated brake cylinder.

9. A brake rigging for a railway vehicle, according to claim 8, wherein said fluid pressure operated brake cylinder is mounted on one of said first brake beam and said second brake beam.

10. A brake rigging for a railway vehicle, according to claim 8, wherein said fluid pressure operated brake cylinder is mounted on such vertical predetermined side wall portion of such bolster.

11. A brake rigging for a railway vehicle, according to claim 1, wherein said adjustable length second force transmitting means acts as a solid rod like member during a brake application and becomes adjustable upon a brake release.

12. A brake rigging for a railway vehicle, according to claim 11, wherein said adjustable length second force transmitting means is a slack adjuster.

13. A brake rigging for a railway vehicle, according to claim 12, wherein said means engageable with said adjustable length second force transmitting means is a trigger mechanism.

14. A brake rigging for a railway vehicle, according to claim 13, wherein said trigger mechanism is pivotable.

15. A brake rigging for a railway vehicle, according to claim 13, wherein said means engageable a predetermined portion of said brake rigging engages with said trigger for effecting a change in a length of said slack adjuster.

16. A brake rigging for a railway vehicle, according to claim 3, wherein each of said first brake beam and said second brake beam include guide means disposed at each outer end thereof.

17. A brake rigging for a railway vehicle, according to claim 16, wherein said compression member of each of said first brake beam and said second brake beam include guide means disposed at each outer end thereof which are slideably engaged in channels disposed inside each side frame of such pair of side frames for guiding such brake rigging during such brake application.

18. A brake rigging for a railway vehicle, according to claim 1, wherein said means engageable with each said brake shoe assembly disposed closely adjacent said respective end of each said first brake beam and said second brake beam for securing a brake shoe thereon to be brought into frictional engagement with a respective confronting wheel of said second wheel and axle set during such brake application includes a key.

19. A brake rigging for a railway vehicle, according to claim 1, wherein each of said first force transfer means and said second force transfer means includes at least one lever.

20. A brake rigging for a railway vehicle, according to claim 1, wherein at least one of said first force transfer means and said second force transfer means includes a pair of levers.

21. A brake rigging for a railway vehicle, said brake rigging comprising:

(a) a first brake beam disposed in a substantially horizontal plane between a first vertically disposed side of a truck bolster having each end thereof disposed intermediate each end of a respective one of a pair of side frames of a railway vehicle truck and a first wheel and axle set disposed closely adjacent one end of such pair of side frames forming a portion of such railway vehicle truck at least partially supporting one end of such railway vehicle, said first brake beam being disposed adjacent an outer end of such railway vehicle truck;

(b) a brake shoe assembly disposed closely adjacent each respective end of said first brake beam;

(c) means engageable with each said brake shoe assembly disposed closely adjacent a respective end of said first brake beam for securing a brake shoe thereon to be brought into frictional engagement with a respective confronting wheel of such first wheel and axle set during a brake application;

(d) a second brake beam disposed in a substantially horizontal plane between a radially opposed and vertically disposed second side of such truck bolster and a second wheel and axle set disposed closely adjacent a radially opposed second end of such pair of side frames forming a remaining portion of such railway vehicle truck supporting such one end of such railway vehicle, said second brake beam assembly being disposed towards an inner end of such railway vehicle truck;

(e) a brake shoe assembly disposed closely adjacent each respective end of said second brake beam;

(f) means engageable with each said brake shoe assembly disposed closely adjacent said respective end of said second brake beam for securing a brake shoe thereon to be brought into frictional engagement with a respective confronting wheel of said second wheel and axle set during such brake application;

(g) a first force transfer means pivotally connected at a predetermined point disposed intermediate a first end and a radially opposed second end of said first force transfer means to said first brake beam for transferring a force applied thereto in order to assist in moving a brake shoe carried by a respective said brake shoe assembly disposed closely adjacent said each end of said first brake beam into frictional engagement with such respective confronting wheel of an associated one of such first wheel and axle set during a brake application;

(h) a second force transfer means pivotally connected at a predetermined point intermediate a first end and a second end of said second force transfer means to said second brake beam for transferring a force applied thereto in order to assist in moving such brake shoes carried closely adjacent each end of said second brake beam into frictional engagement with such respective confronting wheel of an associated one of such second wheel and axle set during a brake application;

(i) a first force transmitting means engageable with said second brake beam, said first force transmitting means including a first rod like member having a first end thereof connected to one predetermined end of said first force transfer means, said first force transmitting means further including a second rod like member having a first end thereof connected to one predetermined end said second force transfer means, said second rod like member being extendable and having a second end thereof connected to a first side of a piston like member, said first force transmitting means further including a means for exerting fluid pressure on a radially opposed second side of said piston like member thereby extending said second rod like member and effecting rotation of said second force transfer means;

(j) an adjustable length second force transmitting means having one end thereof connected to a second end of said first force transfer means and another end thereof connected to said second force transfer means; and (k) a means engageable with said adjustable length second force transmitting means and a predetermined portion of said brake rigging for effecting a change in a length of said adjustable length second force transmitting means as necessary due to at least one of wear of brake shoes attached to said brake shoe assembly disposed closely adjacent each end of each of said first brake beam and said second brake beam and loss of a brake shoe from at least one brake shoe assembly.

* * * * *